US008033126B2

(12) United States Patent
Newton et al.

(10) Patent No.: US 8,033,126 B2
(45) Date of Patent: Oct. 11, 2011

(54) FLOW CONTROLLING ASSEMBLY AND METHOD

(75) Inventors: William Newton, Brooks, KY (US); Arthur Wilson Scrivener, Louisville, KY (US); Richard Devos, Goshen, KY (US); Kristen Kamath, Palatine, IL (US); Sanjeev Kumar Singh, Firozabad (IN); Timothy Allen Hamel, Louisville, KY (US); Preston Howard, Katy, TX (US)

(73) Assignee: General Electric Company, Schenectady, NY (US)

( * ) Notice: Subject to any disclaimer, the term of this patent is extended or adjusted under 35 U.S.C. 154(b) by 311 days.

(21) Appl. No.: 11/562,432

(22) Filed: Nov. 22, 2006

(65) Prior Publication Data

US 2008/0248738 A1 Oct. 9, 2008

(51) Int. Cl.
*F25D 17/04* (2006.01)

(52) U.S. Cl. ..... 62/187; 62/408

(58) Field of Classification Search ..... 62/408, 62/404, 186, 187, 255; 454/64, 274, 369, 454/363, 366, 286, 124; 16/249; 137/1
See application file for complete search history.

(56) References Cited

U.S. PATENT DOCUMENTS

| | | | | |
|---|---|---|---|---|
| 4,248,140 | A * | 2/1981 | Hendricks | 454/336 |
| 4,605,198 | A * | 8/1986 | Greiner | 251/58 |
| 6,564,819 | B2 * | 5/2003 | Zelczer | 137/15.25 |
| 6,584,790 | B1 * | 7/2003 | Lopes | 62/187 |
| 6,916,240 | B1 * | 7/2005 | Morton | 454/286 |
| 2004/0031276 | A1 * | 2/2004 | Cho et al. | 62/186 |

* cited by examiner

*Primary Examiner* — Mohammad Ali
(74) *Attorney, Agent, or Firm* — Global Patent Operation; Douglas D. Zhang

(57) ABSTRACT

A flow controlling assembly configured to permit air flow between a first chamber and a second chamber. A frame member includes a damper contacting surface at least partially surrounding a frame opening configured to permit the air flow therethrough. A damper plate includes a frame contacting surface configured to contact the damper contacting surface when the damper plate is in a closed position. A hinge assembly is disposed between the frame member and the damper plate. The hinge assembly is configured to permit the damper plate to rotate on a rotational axis relative to the frame member and to permit the rotational axis to translate relative to the frame member.

19 Claims, 4 Drawing Sheets

FLOW CONTROLLING ASSEMBLY AND METHOD

BACKGROUND OF THE INVENTION

The described technology relates to a flow controlling assembly and method, such as for a refrigerator.

In a known refrigerator, air in a freezer compartment is cooled by a cooling system. Such a cooling system is well known. This cooled air is directed to a fresh food compartment of the refrigerator, through the use of a damper disposed between the freezer and fresh food compartments. By this arrangement, a single cooling system can be used to cool both the freezer and fresh food compartments. The damper is associated with an electromechanical system that either fully opens or fully closes the damper. For example, when the cooling system is deenergized, the damper is fully closed so that the temperature in the freezer compartment is maintained below a predetermined minimum temperature. When the cooling system is energized, the damper is fully opened so that the cooled air flows from the freezer compartment to the fresh food compartment.

The known refrigerator suffers from numerous disadvantages. For example, a separate control system and numerous electrical and mechanical components are required to control the opening and closing of the damper. Thus, control of the damper is relatively complicated, and installation and service of the control system increase the initial and maintenance costs of the refrigerator. Further, because the damper is either fully opened or fully closed, the flow of the cooled air from the freezer compartment to the fresh food compartment cannot be precisely controlled. As a result, the electrical efficiency of the refrigerator is decreased.

BRIEF DESCRIPTION OF THE INVENTION

As described herein, embodiments of the invention overcome one or more of the above or other disadvantages known in the art.

In an embodiment, a flow controlling assembly is configured to permit air flow between a first chamber and a second chamber. A frame member includes a damper contacting surface at least partially surrounding a frame opening configured to permit the air flow therethrough. A damper plate includes a frame contacting surface configured to contact the damper contacting surface when the damper plate is in a closed position. A hinge assembly is disposed between the frame member and the damper plate. The hinge assembly is configured to permit the damper plate to rotate on a rotational axis relative to the frame member and to permit the rotational axis to translate relative to the frame member.

In another embodiment, a flow controlling assembly includes the frame member, the damper plate, and a subassembly for permitting the damper plate to rotate about a rotational axis relative to the frame member and for permitting the rotational axis to translate relative to the frame member.

In still another embodiment, a refrigerator includes first and second storage compartments, and a damper assembly configured to permit air flow from the first to the second storage compartments. A frame member includes a damper contacting surface at least partially surrounding a frame opening configured to permit the air flow therethrough. A damper plate includes a frame contacting surface. The frame contacting surface is configured to contact the damper contacting surface when the damper plate is in a close position. A hinge assembly is disposed between the frame member and the damper plate. The hinge assembly is configured to permit the damper plate to rotate on a rotational axis relative to the frame member and to permit the rotational axis to translate relative to the frame member.

In still another embodiment, air is permitted to flow from a first side of a flow controlling assembly to a second side of the flow controlling assembly. In this method, a damper plate rotates on a rotational axis when the air flows at a first speed through a void otherwise covered by the damper plate. The rotational axis translates when the air flows at a second speed through the void.

BRIEF DESCRIPTION OF THE DRAWINGS

The following figures illustrate examples of embodiments of the invention. The figures are described in detail below.

DETAILED DESCRIPTION OF EMBODIMENTS OF THE INVENTION

Embodiments of the invention are described below, with reference to the figures. Throughout the figures, like reference numbers indicate the same or similar components.

Figure 1:
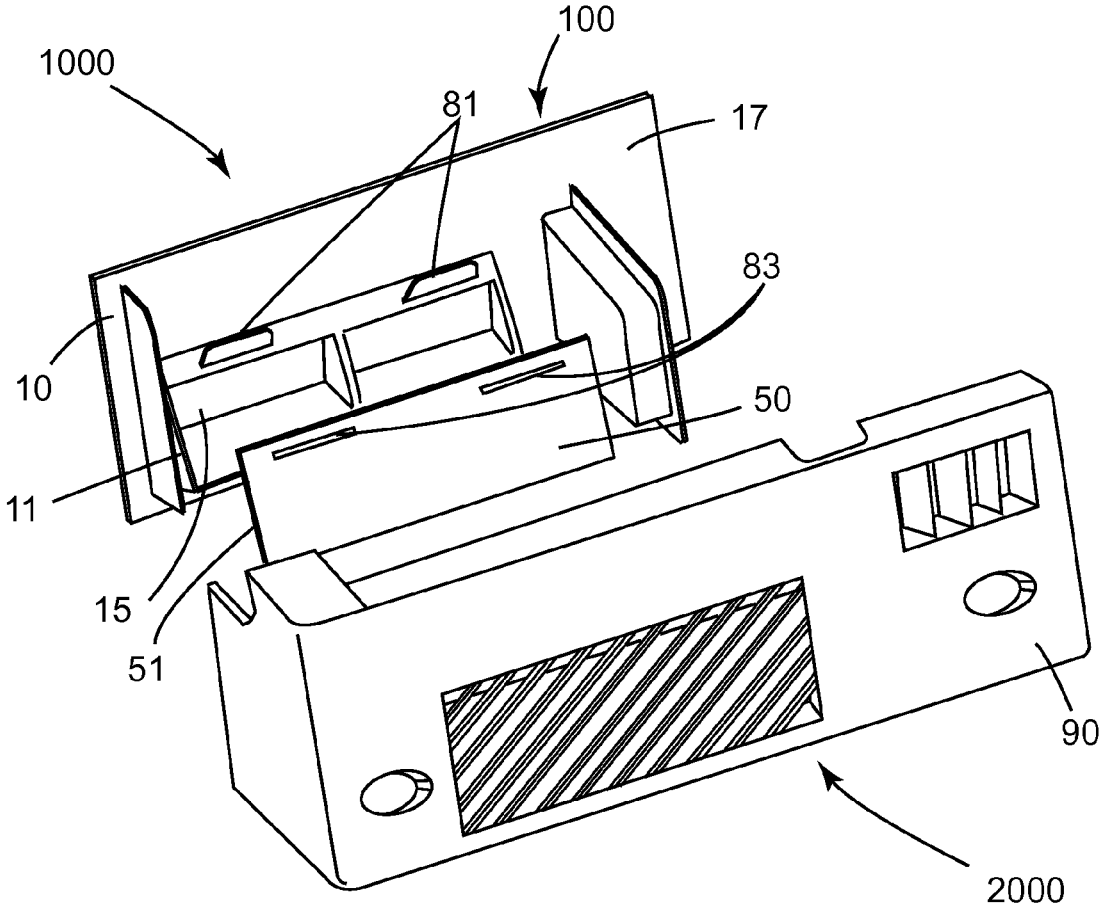
FIG. 1 is an isometric view of an embodiment of a flow controlling assembly, shown in a disassembled state.

FIG. 1 is an isometric view of an embodiment of a flow controlling or damper assembly 100, shown in a disassembled state. The flow controlling assembly 100 controls air flow (e.g., prohibits, impedes, and/or permits air flow) between a first side 1000 and a second side 2000 of the flow controlling assembly 100. In an embodiment of the invention, the first and second sides 1000, 2000 can be compartments in a refrigerator, such as a freezer compartment and a fresh food compartment, respectively. It is understood, however, that the flow controlling assembly 100 can be used between other types of compartments in the refrigerator. For example, the flow controlling assembly 100 can be used between first and second freezer compartments, at the same or different temperatures, or can be used between first and second fresh food and/or other compartments, at the same or different temperatures. Further, although the drawings illustrate embodiments in which the flow controlling assembly 100 is disposed in direct fluid communication with each of the first and second sides 1000, 2000, it is understood that the flow controlling assembly 100 can be disposed as not to be in direct fluid communication with the first and/or second sides 1000, 2000. For example, ducts or other intervening compartments can be disposed on either or both of the first and second sides 1000, 2000. Still further, the flow controlling assembly 100 is not limited to use within a refrigerator, and is not limited to prohibiting, impeding, and/or permitting the flow of air. Rather, it is understood that the flow controlling assembly 100 can be used wherever it is desired to control flow, such as of a gas or a fluid, between sides of the flow controlling assembly 100.

In the embodiments shown in the drawings, the flow controlling assembly 100 includes a frame member 10 and a damper plate 50. Depending on the arrangement of the frame member 10 and the damper plate 50, flow can be prohibited, impeded, and/or permitted from the first side 1000 to the second side 2000 and/or from the second side 2000 to the first side 1000. Details of the air flow between the first and second sides 1000, 2000 are discussed in detail below.

Figure 2:
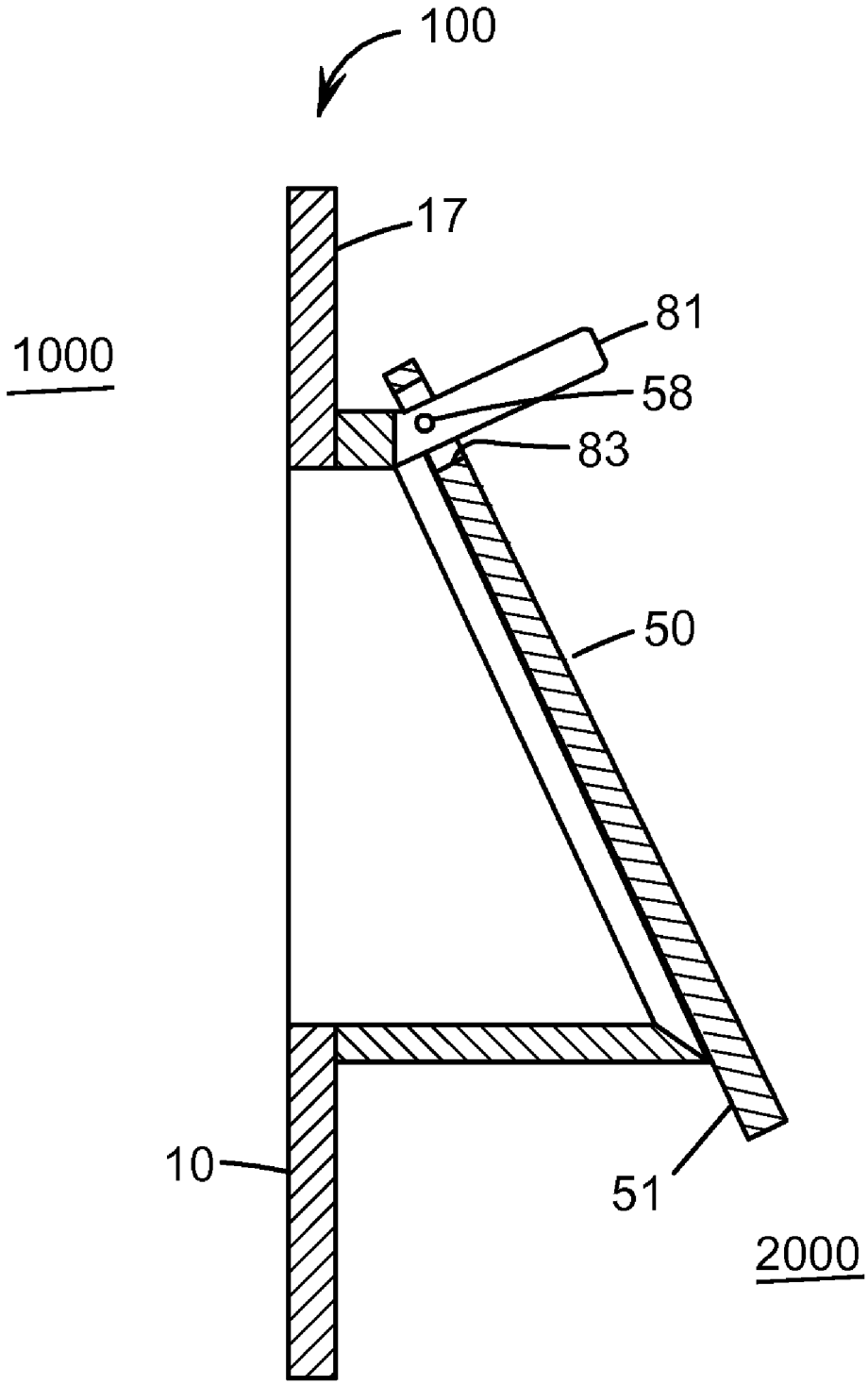
FIG. 2 is a side view of a portion of the flow controlling assembly of FIG. 1, with a damper plate in a close position, with the damper plate and a frame member shown in cross section.

As shown in the drawings, the frame member 10 includes a damper contacting surface 11 that is configured to be adjacent or to contact the damper plate 50 when the damper plate 50 is in the closed position (see, for example, FIG. 2). The damper contacting surface 11 is also configured to be disposed apart from the damper plate 50 when the damper plate 50 is in an opened position (see, for example, FIGS. 3 and 4).

The frame member 10 includes a frame opening or void 15, which permits air flow through the frame member 10, between the first and second sides 1000, 2000. The frame opening 15 is at least partially surrounded by the damper contacting surface 11. By this arrangement, it is understood that flow through the frame member 10 is prohibited, impeded or permitted based on a position of the damper plate 50 (i.e., the degree to which the damper plate 50 is opened or closed) relative to the frame member 10.

The damper contacting surface 11 is disposed at an angle relative to a frame mounting surface 17. As discussed above, in an embodiment the flow controlling assembly 100 is disposed in a refrigerator. In such an embodiment, when the frame member 10 is disposed in a refrigerator in which the freezer compartment is on a left side of the fresh food compartment (i.e., the freezer compartment is one the first side 1000, and the fresh food compartment is on the second side 2000), for example, the frame mounting surface 17 is disposed in an interior wall of the refrigerator between the freezer and fresh food compartments. Both the interior wall of the refrigerator and the frame mounting surface 17 are about perpendicular to a horizontal ground surface on which the refrigerator is disposed. Because the damper contacting surface 11 is tilted, slanted, or otherwise disposed at an angle greater than zero degrees and less than ninety degrees relative to the horizontal ground surface (i.e., at an angle between vertical and horizontal), it is understood that the closing of the damper plate 50 of the flow controlling assembly 100 is facilitated, as the damper plate 50 is not required to achieve a fully vertical orientation before resting on the damper contacting surface 11.

As discussed above, the damper plate 50 is configured to move relative to the frame member 10, to permit, impede, or prohibit flow through the frame opening 15, to thereby control air flow through the flow controlling assembly 100. The damper plate 50 includes a frame contacting surface 51 that is configured to be adjacent or to contact the damper contacting surface 11 of the frame member 10 when the damper plate 50 is in the closed position (see, for example, FIG. 2). The frame contacting surface 51 is also configured to be disposed apart from the damper contacting surface 11 of the frame member 10 when the damper plate 50 is in an opened position (see, for example, FIGS. 3 and 4).

The flow controlling assembly 100 includes a subassembly disposed between the frame member 10 and the damper plate 50. The subassembly is configured to permit the damper plate 50 to rotate on a rotational axis relative to the frame member 10, and to permit the rotational axis to translate relative to the frame member 10. Specifically, a discussed in detail below, a hinge assembly permits the damper plate 50 to rotate and/or translate relative to the frame member 10 when the damper plate 50 is moved to a first, partially opened position (see, for example, FIG. 3), and to further rotate and/or translate relative to the frame member 10 when the damper plate 50 is moved to a second, more fully opened position (see, for example, FIG. 4). Thus, in contrast to other known assemblies, the damper plate 50 is configured to both rotate and translate relative to the frame member 10.

Figure 3:
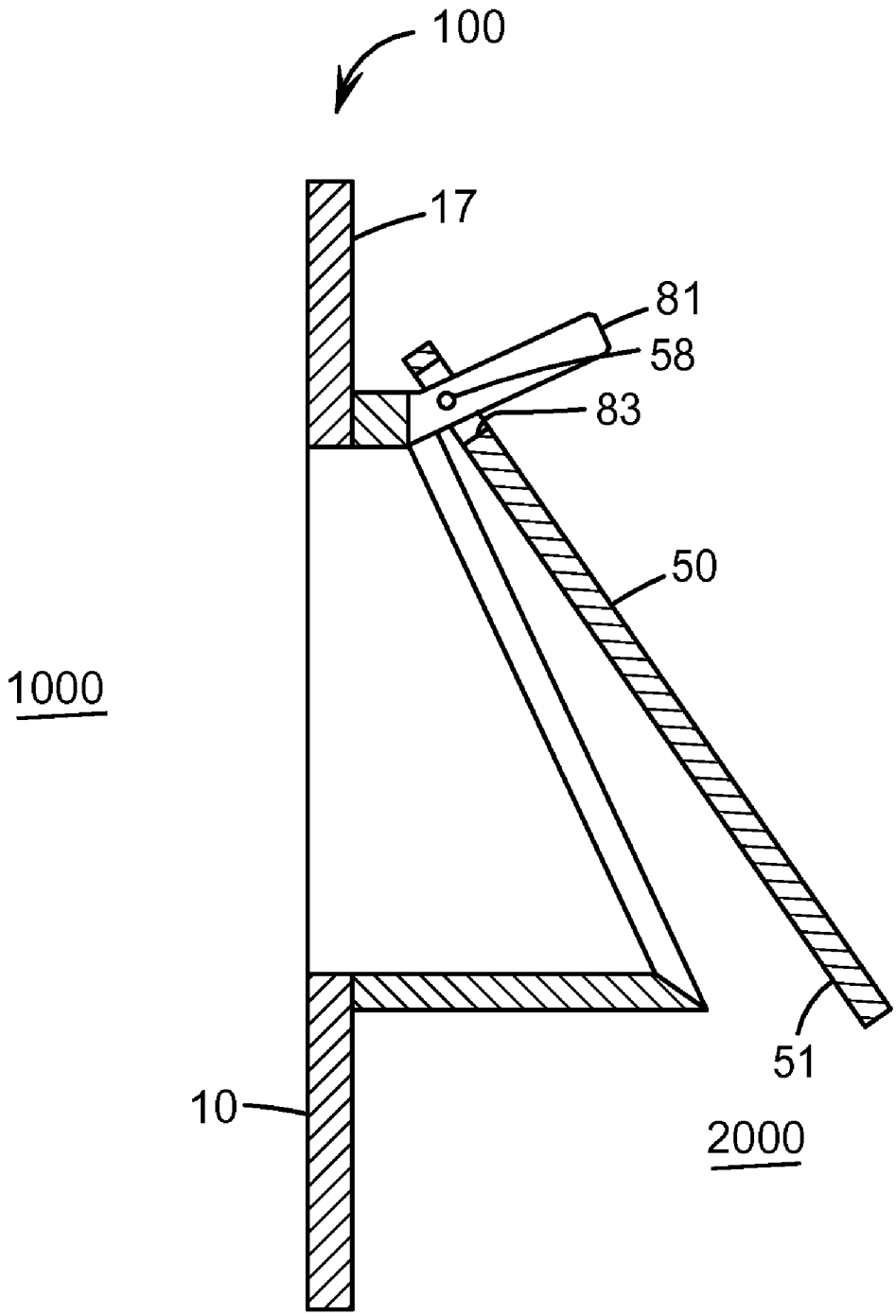
FIG. 3 is a view similar to FIG. 2, with the damper plate in a partially opened position.
Figure 4:
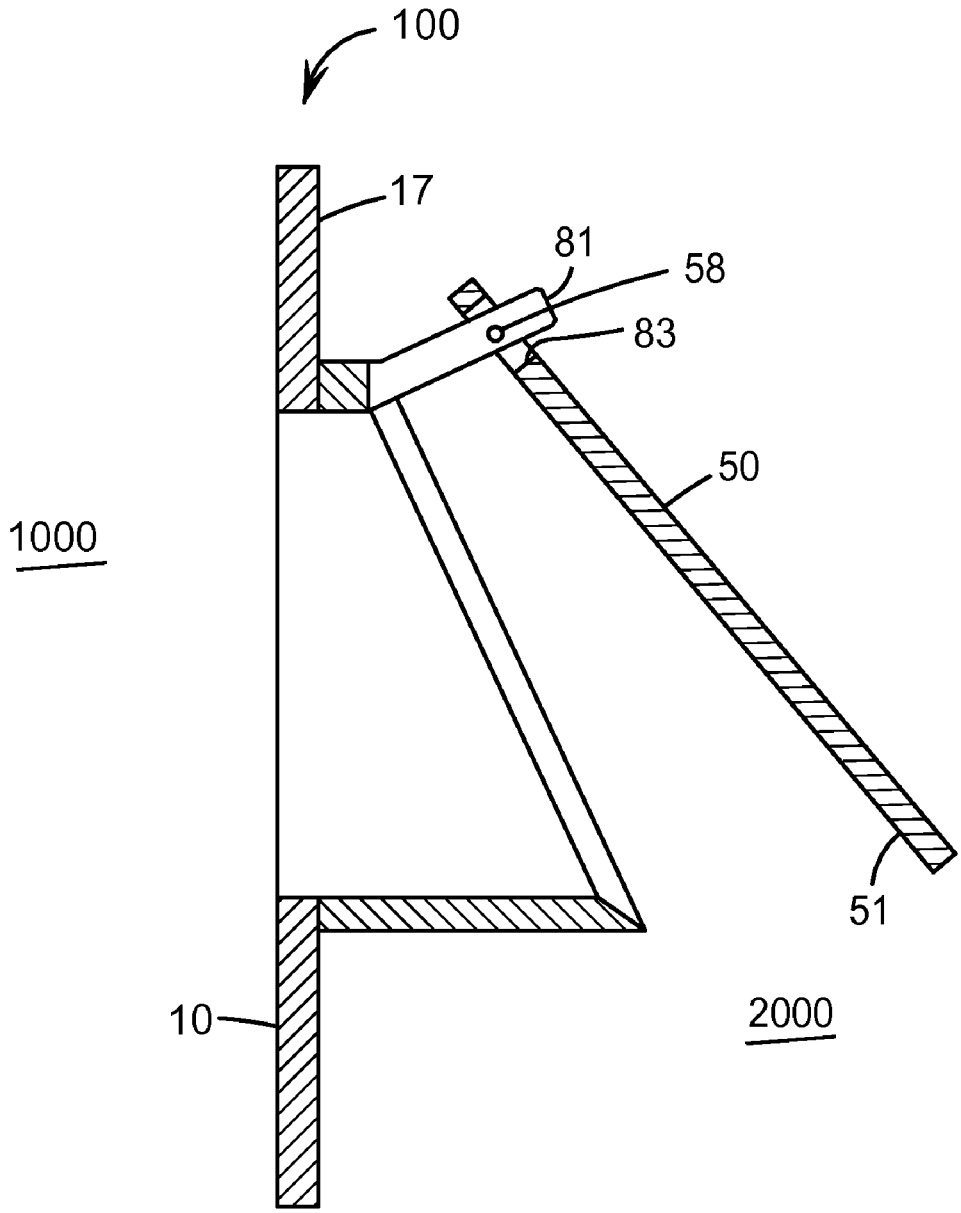
FIG. 4 is a view similar to FIG. 2, with the damper plate in a more fully opened position than that shown in FIG. 3.

As shown in FIG. 3, in response to air flow (positive pressure) on the first side 1000, the damper plate 50 rotates about a rotational axis 58, and/or translates such that the rotational axis 58 is displaced relative to the frame member 10, as compared to the closed position illustrated in FIG. 2. As a result of the rotation and/or translation, the damper plate 50 is displaced from the damper contacting surface 11 of the frame member 10, and air is permitted to flow from the first side 1000 to the second side 2000 through the flow controlling assembly 100. As shown in FIG. 4, in response to an increased air flow (positive pressure) on the first side 1000, the damper plate 50 further rotates about the rotational axis 58, and/or the rotational axis 58 further translates and is further displaced relative to the frame member 10, as compared to the less fully opened position illustrated in FIG. 3. Because the damper plate 50 is configured to both rotate and translate as discussed, air flow through the flow controlling assembly 100 can be maximized, as compared to a damper that only either rotates or translates. Further, because the damper plate 50 is a passive system, requiring no separate controller or complicated electrical and mechanical assembly, but rather moves as a result of air movement (positive pressure) on the first side 1000, installation, assembly and maintenance of the flow controlling assembly 100 is greatly simplified, and costs associated therewith are greatly reduced.

In the embodiments shown in the drawings, the hinge assembly includes at least one protrusion 81 on either the frame member 10 or the damper plate 50, and at least one corresponding void 83 on the other one of the damper plate 50 and the frame member 10. Although the drawings depict two voids 83 on the damper plate 50, and two corresponding protrusions 81 on the frame member 10 which are disposed within the two voids 83, a greater or lesser number of voids and protrusions 83, 81 can be used. Further, each of the voids and protrusions 83, 81 can be disposed on either of the frame member 10 and the damper plate 50. Still further, it is understood that the hinge assembly is not limited to the use of voids and protrusions, but rather can include other structural components that permit the damper plate 50 to rotate and translate relative to the frame member 10 as discussed.

As shown in the drawings, in the embodiments the two protrusions 81 extend at an angle grater than zero degrees and less than ninety degrees relative to the frame mounting surface 17 (i.e., at an angle between vertical and horizontal). As a result, the damper plate 50 is better retained on the frame member 10. However, the protrusions 81 can extend at different angles relative to the frame mounting surface, and can extend along different paths, such as straight lines, arcs, and combinations thereof. The protrusions 81 can also include one or more stop members to prevent unintended or unauthorized removal of the damper plate 50 from the frame member 10. For example, in an embodiment, the protrusion 81 can include the stop member that has a predetermined length in a predetermined direction which is at least equal to a predetermined length in the predetermined direction of the corresponding void 83.

It is understood that the flow controlling assembly 100 can include additional components. For example, the flow controlling assembly 100 can include housing members on either or both sides thereof, for aesthetic reasons and/or to direct air flow to or from the flow controlling assembly 100. The embodiment shown in FIG. 1 includes such as a housing member 90 disposed on the second side 2000.

Thus, in an embodiment, the flow controlling assembly 100 permits the air flow from the first side 1000 of the flow controlling assembly 100, which is the freezer compartment of the refrigerator, to the second side 2000 of the flow controlling assembly 100, which is the fresh food compartment of the refrigerator. When the damper plate 50 is in the closed position, because a sufficient positive pressure does not exist on the first side 1000 relative to the second side 2000, such as when a fan or blower that would otherwise flow air on the first side 1000 is deenergized, the damper contacting surface 11 of the frame member 10 contacts the frame contacting surface 51 of the damper plate 50. By this arrangement, air flow from the first side 1000 to the second side 2000 is prevented or impeded, depending on the design requirements of the refrigerator using the flow controlling assembly 100. As a result, a predetermined minimum temperature is maintained within the freezer compartment. FIG. 2 exemplifies this operating mode.

When a pressure difference exists between the first and second sides 1000, 2000 as a result of a positive pressure on the first side 1000, such as when the fan or blower is energized to flow air on the first side 1000 at a first speed, the damper contacting surface 11 of the frame member 10 is moved out of contact with the frame contacting surface 51 of the damper plate 50. This partial opening occurs as a result of one or both of rotation of the damper plate 50 relative to the frame member 10 and translation of the rotational axis 58 of the damper plate 50 relative to the frame member 10. FIG. 3 exemplifies this operating mode.

When a relatively larger pressure different exists between the first and second sides 1000, 2000 as a result of a relatively larger positive pressure on the first side, such as when the fan or blower is energized to flow air on the first side 1000 at a second speed greater than the first speed, the damper contacting surface 11 of the frame member 10 is moved further out of contact with the frame contacting surface 51 of the damper plate 50. This more full opening occurs as a result of one or both of further rotation of the damper plate 50 relative to the frame member 10 and further translation of the rotational axis 58 of the damper plate 50 relative to the frame member 10. FIG. 4 exemplifies this operating mode.

As further shown in the figures, because the damper plate 50 extends in at least one predetermined direction for a predetermined length that is equal to or greater than the predetermined length in the same predetermined direction of the frame opening 15, the flow controlling assembly 100 acts as a one way valve, permitting the damper plate 50 to only open in one direction. Restated, the damper plate 50 extends beyond the frame opening 15 in at least one direction, and therefore is prevented from rotation in the opposite direction. Further, in the embodiments shown in the drawings, the damper plate 50 extends beyond the damper contacting surface 51 by a predetermined amount sufficient to reduce the incidents of freezing of the damper plate 50 to the frame member 10.

The frame member 10 and/or the damper plate 50 can be further configured to reduce freezing of the damper plate 50 to the frame member 10. For example, one or both of the frame member 10 and the damper plate 50 can be configured such that warmer air from the fresh food compartment flows around a bottom end of the damper plate 50 opposite the protrusions 81 which contacts the damper contacting surface 11, such that the warmer air can warm the contacting surfaces therebetween. In specific embodiments, one or both of the frame member 10 and the damper plate 50 can include at least one protrusion between the contacting surfaces. The protrusion can also minimize a contact area between the contacting surfaces, which can further reduce freezing of the frame member 10 and the damper plate 50.

This written description uses examples to disclose embodiments of the invention, including the best mode, and also to enable a person of ordinary skill in the art to make and use embodiments of the invention. It is understood that the patentable scope of embodiments of the invention is defined by the claims, and can include additional components occurring to those skilled in the art. Such other examples are understood to be within the scope of the claims.

The invention claimed is:

1. A flow controlling assembly configured to permit air flow between a first chamber and a second chamber, the flow controlling assembly comprising:

a frame member including a damper contacting surface at least partially surrounding a frame opening configured to permit the air flow therethrough, and a bottom wall of the frame opening, the damper contacting surface being disposed at an interior angle of less than 90 degrees but greater than zero degrees relative to the bottom wall of the frame opening; and a damper plate including a frame contacting surface, the frame contacting surface being configured to contact the damper contacting surface when the damper plate is in a closed position, wherein one of the frame member and the damper plate has at least one void, and the other of the frame member and the damper plate has at least one protrusion received in the at least one void, the at least one void and the at least one protrusion being disposed above the frame opening;

wherein the damper plate is configured to rotate about a rotational axis which translates relative to the frame when there is a predetermined positive air pressure difference between the first chamber and the second chamber.

2. The flow controlling assembly according to claim 1, wherein the at least one protrusion comprises a plurality of protrusions and the at least one void comprises a plurality of voids.

3. The flow controlling assembly according to claim 2, wherein at least one of the plurality of protrusions comprises a stop member configured to impede removal of the damper plate from the frame member.

4. The flow controlling assembly according to claim 2, wherein the plurality of protrusions is on the frame member, and the plurality of voids is on the damper plate.

5. The flow controlling assembly according to claim 4, wherein at least one of the protrusions comprises a stop member having a predetermined length extending in a predetermined direction, where the stop member predetermined length is at least equal to a predetermined length in the predetermined direction of the corresponding void.

6. The flow controlling assembly according to claim 1, wherein the damper plate has a predetermined length extending in a predetermined direction, where the damper plate predetermined length is at least equal to a predetermined length in the predetermined direction of the frame opening.

7. The flow controlling assembly according to claim 1, wherein the damper plate extends beyond the damper contacting surface in at least one direction when the damper plate is in the closed position.

8. The flow controlling assembly according to claim 1, wherein the frame member further includes a top wall of the frame opening, the protrusion extending up and away from the top wall.

9. The flow controlling assembly according to claim 8, further comprising a frame mounting surface, both the top wall and the bottom wall extending outward from the frame mounting surface, the bottom wall extending further away from the frame mounting surface than the top wall does.

10. A refrigerator comprising:

a first storage compartment and a second storage compartment; and a damper assembly configured to permit air flow from the first storage compartment to the second storage compartments, the damper assembly comprising:

a frame member including a damper contacting surface at least partially surrounding a frame opening configured to permit the air flow therethrough; and a damper plate including a frame contacting surface, the frame contacting surface being configured to contact the damper contacting surface when the damper plate is in a closed position, wherein one of the frame member and the damper plate has at least one void, and the other of the frame member and the damper plate has at least one protrusion received in the at least one void, the at least one void and the at least one protrusion being disposed above the frame opening, wherein the damper plate is configured to rotate about a rotational axis which translates relative to the frame member from the closed position to a partial open position only when there is a predetermined positive air pressure difference between the first chamber and the second chamber.

11. The refrigerator according to claim 10, further comprising a positive pressure generating device disposed within the first storage compartment.

12. The refrigerator according to claim 11, wherein the damper plate extends beyond the damper contacting surface in at least one direction when the damper plate is in the closed position to thereby prevent air flow from the second storage compartment to the first storage compartment.

13. The refrigerator according to claim 12, wherein at least a portion of the damper contacting surface is disposed at an angle greater than zero degrees and less than ninety degrees relative to a surface on which the refrigerator is disposed.

14. The refrigerator according to claim 10, wherein the at least one protrusion comprises a plurality of protrusions and the at least one void comprises a plurality of voids.

15. The refrigerator according to claim 14, wherein the plurality of protrusions is on the frame member, and the plurality of voids is on the damper plate.

16. The refrigerator according to claim 14, wherein at least one of the protrusions comprises a stop member having a predetermined length extending in a predetermined direction, where the stop member predetermined length is at least equal to a predetermined length in the predetermined direction of the corresponding void.

17. The refrigerator according to claim 10, wherein the damper plate rotates about the rotational axis or translates relative to the frame member to a full open position when there is a second predetermined positive air pressure difference between the first storage compartment and the second storage compartment, the second predetermined positive air pressure difference being greater than the first predetermined positive air pressure difference.

18. The refrigerator according to claim 10, wherein the damper plate rotates about the rotational axis and translates relative to the frame member to a full open position when there is a second predetermined positive air pressure difference between the first storage compartment and the second storage compartment, the second predetermined positive air pressure difference being greater than the first predetermined positive air pressure difference.

19. A flow controlling assembly for controlling a fluid flow from a first chamber to a second chamber, comprising:

a frame member having an opening between the first chamber and the second chamber for the fluid flow;

a damper plate rotatably and translatively supported by the frame member, the damper plate rotating and translating relative to the frame member among a first position, a second position, and a third position, in the first position the damper plate resting on the frame opening to impede the fluid flow, in the second position the damper plate rotating and translating from the first position to partially open the opening, in the third position the damper plate rotating and translating farther from the first position to fully open the opening;

at least one protrusion on one of the frame member and the damper plate; and the other of the frame member and the damper plate including a corresponding void, the at least one protrusion being configured to be received in the corresponding void, the at least one protrusion and the corresponding void being disposed above the opening between the first chamber and the second chamber.

* * * * *